US010118808B2

(12) United States Patent
Sunderhaus et al.

(10) Patent No.: US 10,118,808 B2
(45) Date of Patent: Nov. 6, 2018

(54) LOAD-COMPENSATING ROPE SHEAVE ARRANGEMENT

(71) Applicant: SIEMAG TECBERG GmbH, Haiger (DE)

(72) Inventors: Hubert Sunderhaus, Duelmen (DE); Marc Roman Buedenbender, Netphen (DE); Peter Boerner, Kreuztal (DE)

(73) Assignee: SIEMAG TECBERG GMBH, Haiger (DE)

( * ) Notice: Subject to any disclaimer, the term of this patent is extended or adjusted under 35 U.S.C. 154(b) by 343 days.

(21) Appl. No.: 14/898,577

(22) PCT Filed: Jun. 13, 2014

(86) PCT No.: PCT/EP2014/062460
§ 371 (c)(1),
(2) Date: Dec. 15, 2015

(87) PCT Pub. No.: WO2014/202487
PCT Pub. Date: Dec. 24, 2014

(65) Prior Publication Data

US 2016/0115002 A1 Apr. 28, 2016

(30) Foreign Application Priority Data

Jun. 18, 2013 (DE) ..... 10 2013 010 273

(51) Int. Cl.

| | |
|---|---|
| ***B66D 1/50*** | (2006.01) |
| ***B66D 1/58*** | (2006.01) |
| ***B66B 7/10*** | (2006.01) |
| ***B66C 13/04*** | (2006.01) |
| ***B66D 1/36*** | (2006.01) |
| ***B66D 5/02*** | (2006.01) |

(52) U.S. Cl.
CPC ..... *B66D 1/58* (2013.01); *B66B 7/10* (2013.01); *B66C 13/04* (2013.01); *B66D 1/36* (2013.01); *B66D 1/50* (2013.01); *B66D 5/02* (2013.01)

(58) Field of Classification Search
CPC ... B66D 1/36; B66D 1/50; B66D 1/56; B66D 1/58; B66B 7/10
See application file for complete search history.

(56) References Cited

U.S. PATENT DOCUMENTS 1,311,108 A 7/1919 Beckwith
1,887,306 A * 11/1932 Huff ..... B66D 1/36 254/395

(Continued)

FOREIGN PATENT DOCUMENTS

CN 1178189 A 4/1998
CN 101279688 A 4/2011

(Continued)

*Primary Examiner* — Emmanuel M Marcelo
(74) *Attorney, Agent, or Firm* — 24IP Law Group; Timothy R. DeWitt

(57) ABSTRACT

The invention relates to a load-compensating rope sheave arrangement for drum winders, comprising at least two rope sheaves which are vertically guided in sliding frames and mounted on hydraulically short-circuited cylinders. Multiply redundant monitoring of the different sheave loads acting upon the rope sheaves is carried out via the hydraulic cylinders which are connected to the system control of the drum winder for communication.

16 Claims, 7 Drawing Sheets

(56) References Cited

U.S. PATENT DOCUMENTS

| | | | | |
|---|---|---|---|---|
| 3,014,699 | A | 12/1961 | Bentley | |
| 3,593,508 | A * | 7/1971 | Jachimowicz | D07B 3/08 57/114 |
| 2006/0243540 | A1 * | 11/2006 | Mustalahti | B66B 7/10 187/412 |

FOREIGN PATENT DOCUMENTS

| | | | |
|---|---|---|---|
| DE | 1208463 | A | 1/1966 |
| GB | 664686 | A | 11/1952 |
| GB | 880311 | A | 10/1961 |

* cited by examiner

LOAD-COMPENSATING ROPE SHEAVE ARRANGEMENT

BACKGROUND OF THE INVENTION

Field of the Invention

The present invention relates to a load-compensation sheave arrangement for drum winders with at least two sheaves that are vertically guided in slide frames and mounted on hydraulically short-circuited cylinders and a corresponding method.

Brief Description of the Related Art

In mining, drum machines are used that coil two ropes unidirectionally (so-called Blair arrangement) which are posted on a conveyor means. During a feed cycle, the two hoisting ropes stretch differently due to their mechanical properties. To compensate this difference in expansion of the hoisting ropes, it is a known approach to provide compensation sheaves which simultaneously ensure that both hoisting ropes are always equally loaded.

Additionally, during the reeling of the ropes on the respective drums of the drum winder, a so-called faulty coiling can occur, in which one of the hoisting ropes is not coiled in the correct rope position.

To ensure that both ropes are equally loaded, the sheaves are mounted on cylinders in vertically guided fashion and said cylinders are hydraulically short-circuited, such that an oil compensation can be effected and the sheaves can adjust vertically such that both ropes bear the same load.

However, the known systems lack the ability to recognize a malfunction on the one hand of the compensation sheave apparatus and/or to recognize a faulty coiling over the loads on the compensation sheaves, and to initiate necessary safety measures.

SUMMARY OF THE INVENTION

It is therefore the object of the present invention to provide a compensation sheave apparatus and a corresponding method for operating the same, which offers the option to recognize and monitor malfunction in the overall system. The system is intended to provide monitoring functions, include security measures and be able to intervene in the machine control of the drum winder which is provided with the compensation sheave device. It is intended to additionally mechanically monitor the hydraulic system of the compensation sheave apparatus in order to indicate a malfunction or failure, and to take security measures.

This object is achieved by the features of the independent patent claims, wherein expedient embodiments are described by the features of the dependent claims.

A compensation sheave arrangement is provided for drum winders with at least two sheaves that are vertically guided in slide frames and mounted on hydraulically short-circuited cylinders, which is characterized in accordance with the present invention in that a multiply redundant monitoring of the varying rope loads acting on the sheaves is provided via the hydraulic cylinders, which is communicatively connected to the system control of the drum winder.

Preferably, the compensation sheave arrangement is characterized by the fact that the multiply redundant monitoring via the hydraulic cylinders of the varying rope loads acting on the sheaves consists of correspondingly at least one linear displacement transducer, at least one limit switch and one cylinder pressure monitoring means.

It is further preferred that a mechanical stop is provided above the respective lower cylinder end point, for safe lowering of the slide frames in the event of an overload in the hydraulic system and avoiding mechanical damage to the corresponding cylinder.

In a further preferred embodiment the compensation sheave arrangement can be characterized in that the hydraulically short-circuited cylinders are arranged on a mechanical load balancing rocker with bilateral, mechanical stop for receiving the loads of the sheaves, said rocker being in balance when the loads on the sheaves are equal. The load balancing rocker can be provided with respective spring assemblies on both sides that permit a tolerance value for the seesawing. Finally, on both sides of the rocker also a linear displacement transducer can be respectively attached for measuring the seesawing, the path difference of which is continuously monitored by the system control of the drum winder.

Further, according to the invention, a method is provided for operating a compensation sheave arrangement for drum winders with at least two sheaves that are vertically guided in slide frames and mounted on hydraulically short-circuited cylinders, which is characterized by providing a monitoring via the hydraulic cylinders of the varying rope loads acting on the rope sheaves, said monitoring being multiply redundant and communicatively connected to the system control of the drum winder.

This method can be configured such that the multiply redundant monitoring provides for a continuous monitoring of the position of the cylinders by a distance measuring system, a monitoring of the position of the cylinders by the provision of limit switches at the transition points of the operating ranges as well as a continuous monitoring of the pressure in the cylinders and a discharging of the oil into a tank upon exceeding a defined value and lowering the slide frames to mechanical stops above the lower cylinder end points.

Further, for monitoring the malfunction of the hydraulically operating system, a mechanical load balancing rocker can be provided with a mechanical stop on both sides for receiving the loads of the sheaves, the rocker being in balance when the loads on the sheaves are equal.

In order to prevent the indication of very small load differences and to counteract a continuous tipping of the load balancing rocker, spring assemblies can further be provided between the cylinders and the load balancing rocker, said spring assemblies permitting a tolerance value for the seesawing, wherein, when this tolerance value is exceeded, the rocker rests on one side and damage to the system is prevented by a corresponding signal to the system control.

Further, a respective linear displacement transducer can be provided on both sides of the load balancing rocker, wherein the path difference thereof is continuously monitored by the system control and, when the difference becomes too great and leaves the tolerance range, the malfunction of the system is detected and a safety braking of the entire system is triggered.

Finally, the hydraulic control of the entire system including the drum winder and the compensation sheave device can be configured such that for maintenance purposes, both cylinders together or each cylinder separately can be lifted and lowered.

In an apparatus and a method as described the compensation of the rope loads is effected hydraulically. The position of the cylinders is monitored continuously. When a cylinder leaves the normal operating range, a warning is given and the operation blocking circuit of the entire system is triggered. When a cylinder leaves the maximum compensation range, a faulty coiling is assumed and a safety braking is triggered. When the load becomes too great in both ropes, damage to the hydraulic system and the cylinders is prevented. A malfunction of the hydraulically operating system is monitored therein by means of the mechanical safety devices.

The apparatus and the method according to the invention therefore offer a multiple monitoring of the varying rope loads by the compensation sheaves, as well as a monitoring of the compensation sheaves and a malfunction of the hydraulic system. In addition, the mechanical stops offer protection of the compensation sheaves from destruction by rope overload or by excessive service load.

BRIEF DESCRIPTION OF THE DRAWINGS

Further characteristics and advantages of the invention result from the following, in no way limiting description of a preferred embodiment of the invention with reference to the attached drawings. The figures are described as follows.

Identical elements are provided with identical reference numerals in all figures.

DETAILED DESCRIPTION OF THE INVENTION

Figure 1:
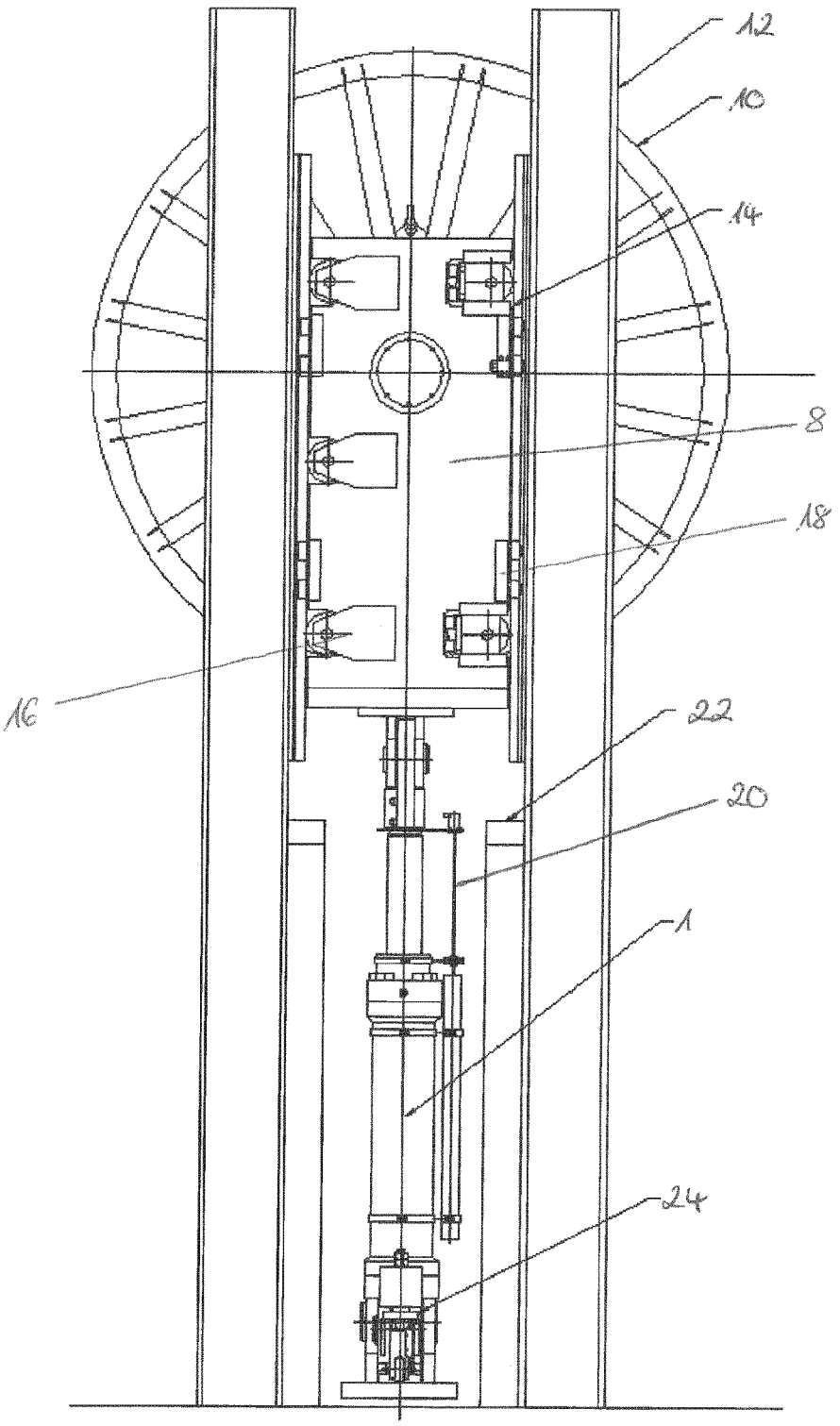
FIG. 1 the side view of an embodiment of the compensation sheave apparatus according to the invention.

From FIG. 1 the side view of a preferred embodiment of the compensation sheave apparatus according to the invention can be gathered. Two sheaves 10 that are vertically guided in slide frames 8 and mounted on hydraulically short-circuited cylinders 1 can be recognized. The guiding by the slide frames 8 is effected therein by means of guide rails 14 arranged on steel posts 12, on which there run front rollers 16 and flank rollers 18 respectively arranged on the slide frames 8.

The compensation sheave apparatus as represented in FIG. 1 has a multiply redundant monitoring via the hydraulic cylinders 1 of the varying rope loads acting on the sheaves 10, said monitoring device being communicatively connected to the system control (not shown) of the drum winder (not shown).

The multiply redundant monitoring via the hydraulic cylinders 1 of the varying rope loads acting on the sheaves 10 in the preferred embodiment consists per cylinder 1 of respectively one linear displacement transducer 20, an upper preliminary circuit breaker 7*c* as well as an upper limit switch 7*b*, a lower preliminary circuit breaker 7*c* as well as an upper limit switch 7*b* and a cylinder pressure monitoring means (not shown) of the cylinders 1. The displacement measuring devices 20 transmit the position of the respective sheave 10 to the electrical control (not shown). The limit switches 7*c*, 7*b* serve for warning and as end position cutout.

Further, it can be gathered from FIG. 1 that in each case a mechanical stop 22 is provided above the respective lower cylinder end point, for safe lowering of the slide frames 8 in the event of an overload in the hydraulic system and for avoiding mechanical damage to the respective cylinder.

Finally, the compensation sheave arrangement according to FIG. 1 has a load balancing rocker 24 for receiving the loads of the sheaves 10 with a mechanical stop on both sides, on which the hydraulically short-circuited cylinders 1 are arranged. This load balancing rocker 24 is in balance when the loads on the sheaves 10 are equal. Moreover, the load balancing rocker 24 is provided with spring assemblies 26 on both sides, said spring assemblies permitting a tolerance value for the seesawing.

Figure 2:
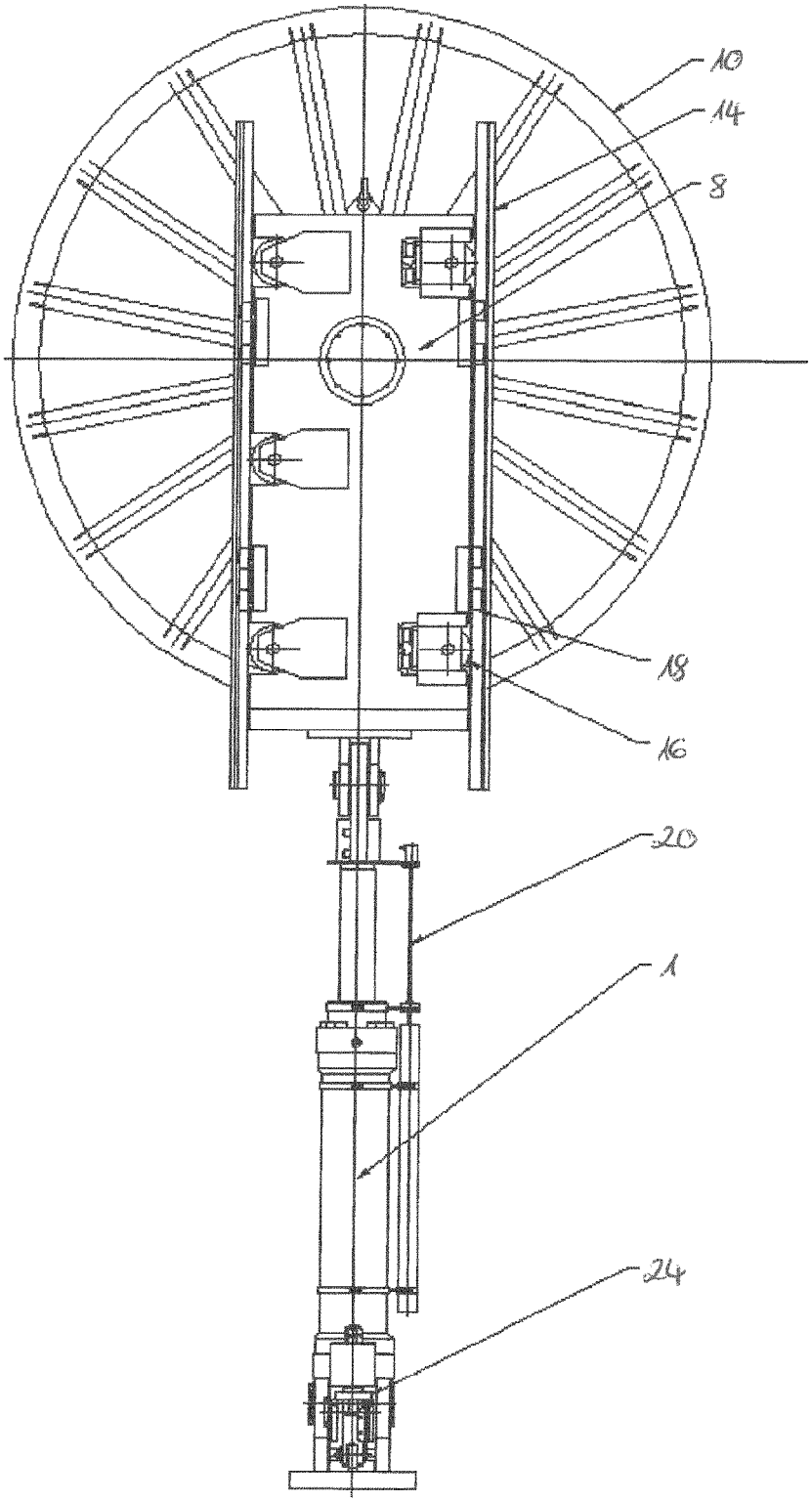
FIG. 2 the compensation sheave apparatus of FIG. 1, represented without a steel construction.

FIG. 2 shows the compensation sheave apparatus according to FIG. 1 represented without steel construction and slightly enlarged for a better visibility of the essential elements of the compensation sheave apparatus. The represented elements are identical to those of FIG. 1.

Figure 3:
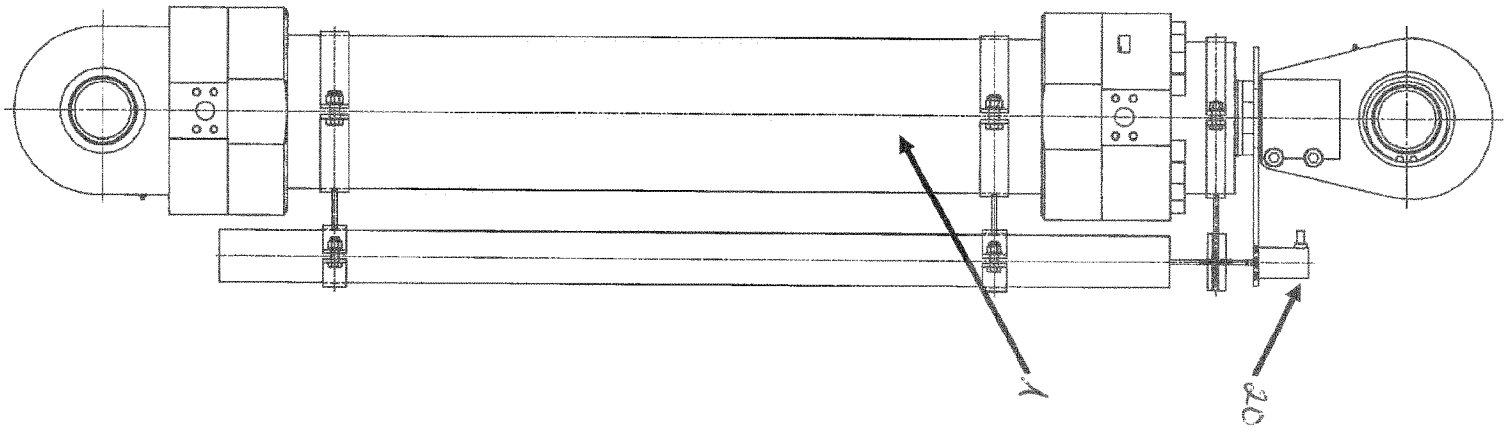
FIG. 3 the isolated view of the compensating cylinder arrangement of the compensation sheave apparatus of FIGS. 1 and/or 2.

FIG. 3 moreover shows an isolated cylinder 1 of the arrangement according to the FIGS. 1 and/or 2. In particular, the linear displacement transducer 20 already mentioned in connection with FIG. 1 that is provided on the cylinder 1 can be recognized clearly here.

Figure 4:
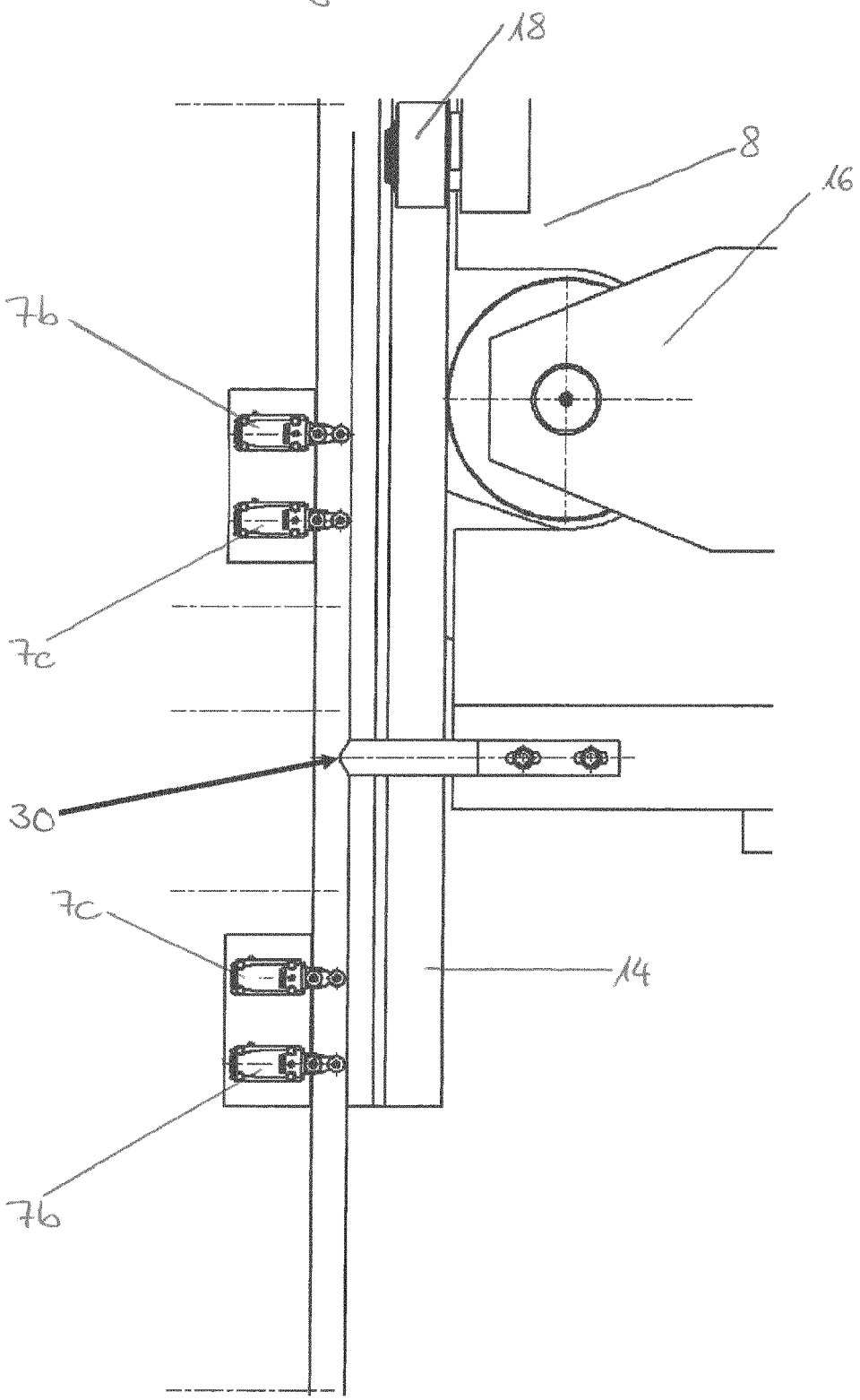
FIG. 4 a detailed view of the limit switch attachment of the compensation sheave apparatus according to FIGS. 1 and/or 2.

FIG. 4 shows a detailed view of the limit switch attachment of the compensation sheave apparatus according to the FIGS. 1 and/or 2. The guide rails 14 can be recognized, on which the front rollers 16 and the flank rollers 18 run that are arranged on the slide frames 8. Also the upper and lower preliminary circuit breakers 7*c* and the upper and lower limit switches 7*b* can be recognized. However, from FIG. 4 also a cam switch 30 arranged on the slide frame 8 can be gathered, with the aid of which the preliminary circuit breakers and the limit switches 7*c*, 7*b* can be actuated when the slide frame 8 overruns a corresponding range, which would lead to the shutdown of the entire system.

Figure 5:
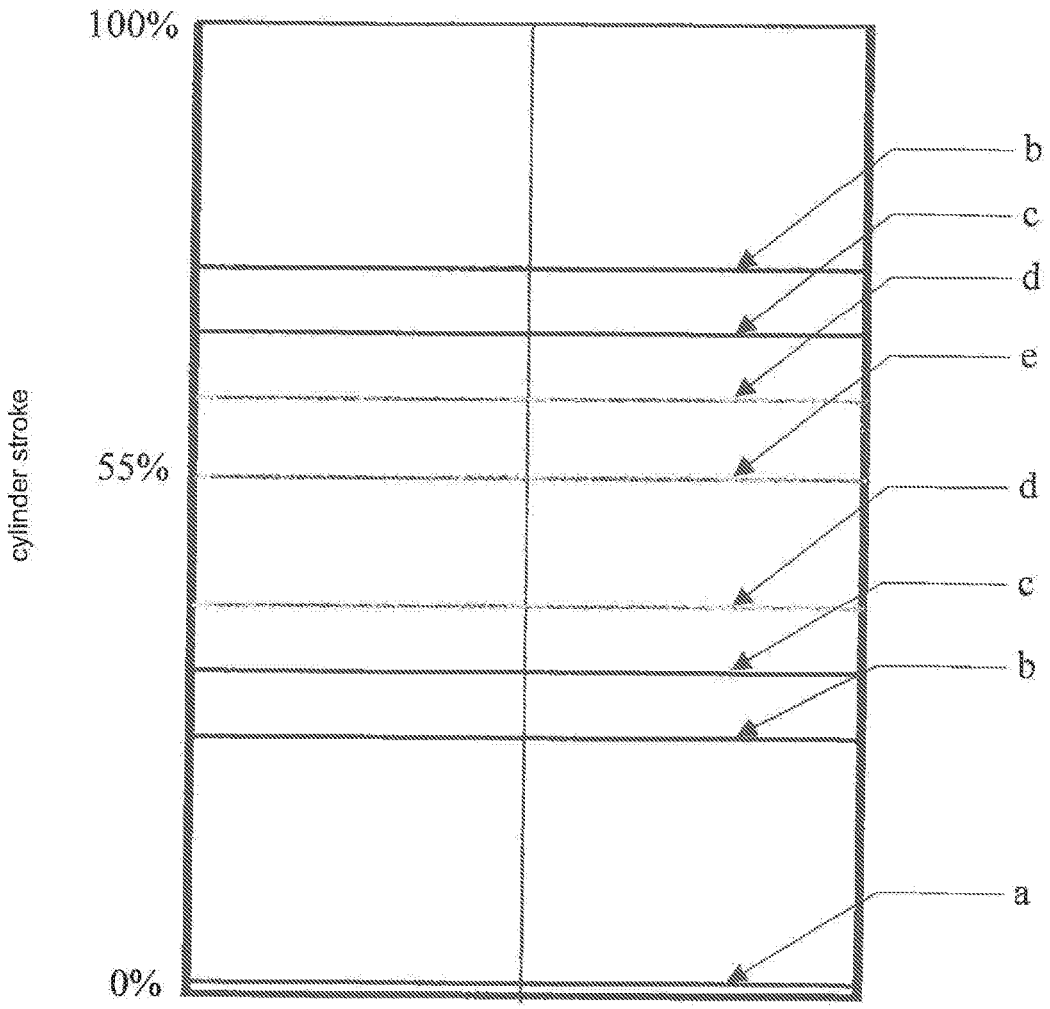
FIG. 5 a diagram illustrating the operating ranges of the cylinder according to FIG. 3.

FIG. 5 shows a diagram illustrating the operating ranges of the cylinder 1 according to FIG. 3 and FIG. 4. The positions b and c correspond to the locations of the preliminary circuit breakers and limit switches 7*c*, 7*b*. The point a) in the diagram defines a mechanical safety range of the cylinder 1 up to the retracted end position.

The points b) each define a border area referred to as safety range and faulty coiling range. When the cam switch is disposed in these ranges, this is a clear indication of a malfunction (faulty coiling) of the system and the system is stopped by safety braking.

The points c) define a border area referred to as maximum compensation range. This is the area into which the cylinders 1 may maximally be deflected in order to compensate differences in the rope loads resting on the sheaves 10, to ensure a load balance in the system. In this area, a warning is given and the system is blocked after completion of the driving cycle (operation blocking circuit).

The points d) define an area referred to as normal operating range. This is the width in which the cylinder 1 is permitted to move normally in order to compensate differences in the rope loads resting on the sheaves 10.

The point e) finally defines the start position of the individual cylinder, which in the represented embodiment is disposed at about 55% of the cylinder traveling distance above the point 0 mm (cylinder fully retracted).

Figure 6:
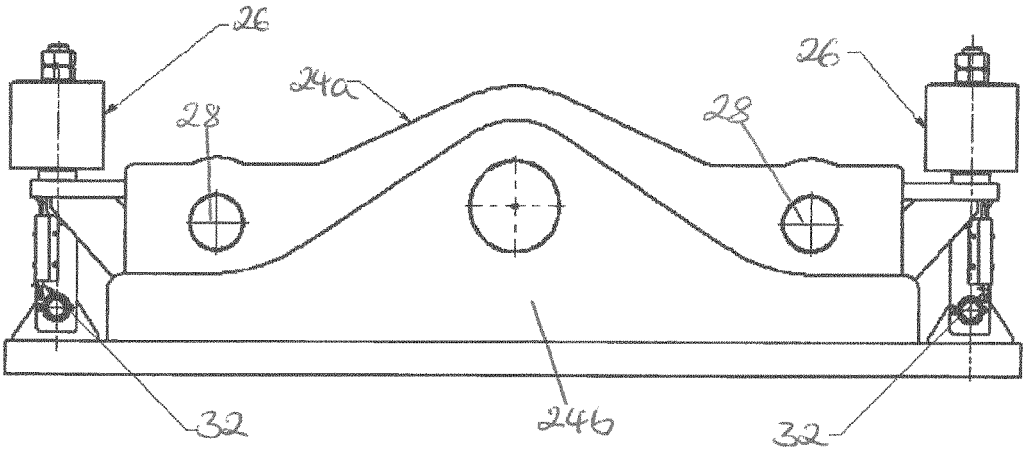
FIG. 6 a detailed view of a load balancing rocker as provided in the compensation sheave apparatus according to FIGS. 1 and/or 2.
Figure 7:
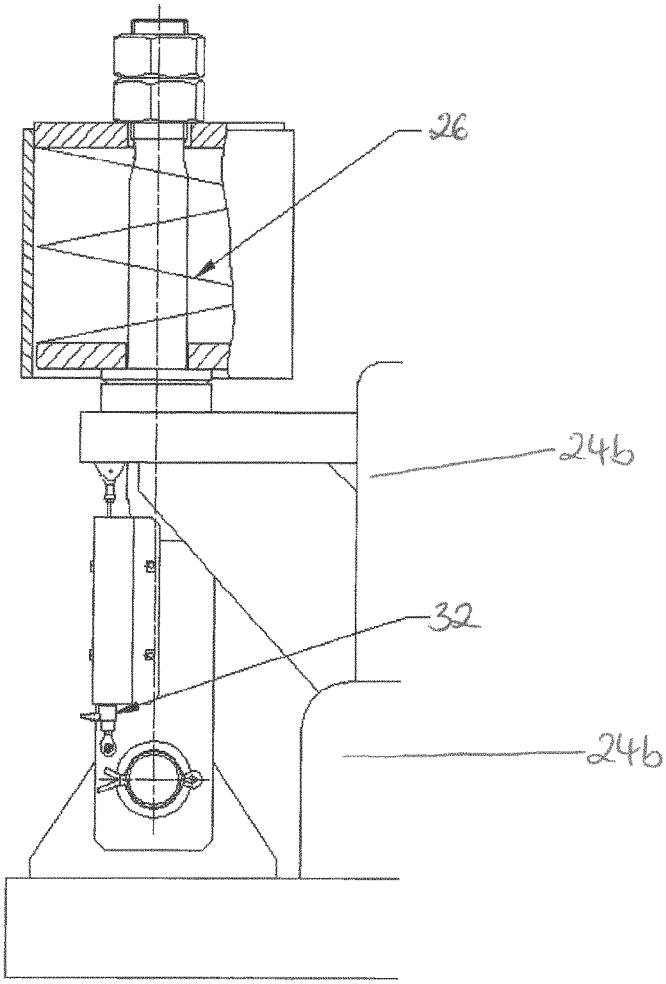
FIG. 7 an enlarged detail of the load balancing rocker according to FIG. 6.

FIG. 6 shows the detailed view of the load balancing rocker 24, as provided in the compensation sheave apparatus according to FIGS. 1 and/or 2. The load balancing rocker 24 consists of the actual rocker 24*a* and the bearing block 24*b*. As can further be gathered from FIG. 6, the rocker has eyes 28 on both sides for fixing the cylinders 1. The load balancing rocker also has on both sides a (not shown) mechanical stop, for the event that the load balancing rocker 24 is significantly deflected. This would only be the case when the loads on the sheaves 10 are unequal, i.e. in the case of a dangerous function or malfunction. With equal loads on the sheaves 10 the load balancing rocker 24 is in balance, however. As can likewise be gathered from FIG. 6, to counteract the indication of very small load differences and the continuous tipping of the load balancing rocker 24, there are spring assemblies 26 mounted in support on both sides of the rocker, said spring assemblies permitting a tolerance value for the seesawing. When this tolerance value is exceeded, the rocker 24 rests on one side and damage to the system is prevented. On both sides of the load balancing rocker 24, as recognizable in FIG. 7, there is also attached a linear displacement transducer 32 respectively, for measuring the seesawing, the path difference of which is continuously monitored by the system control (not shown) of the drum winder.

Figure 8:
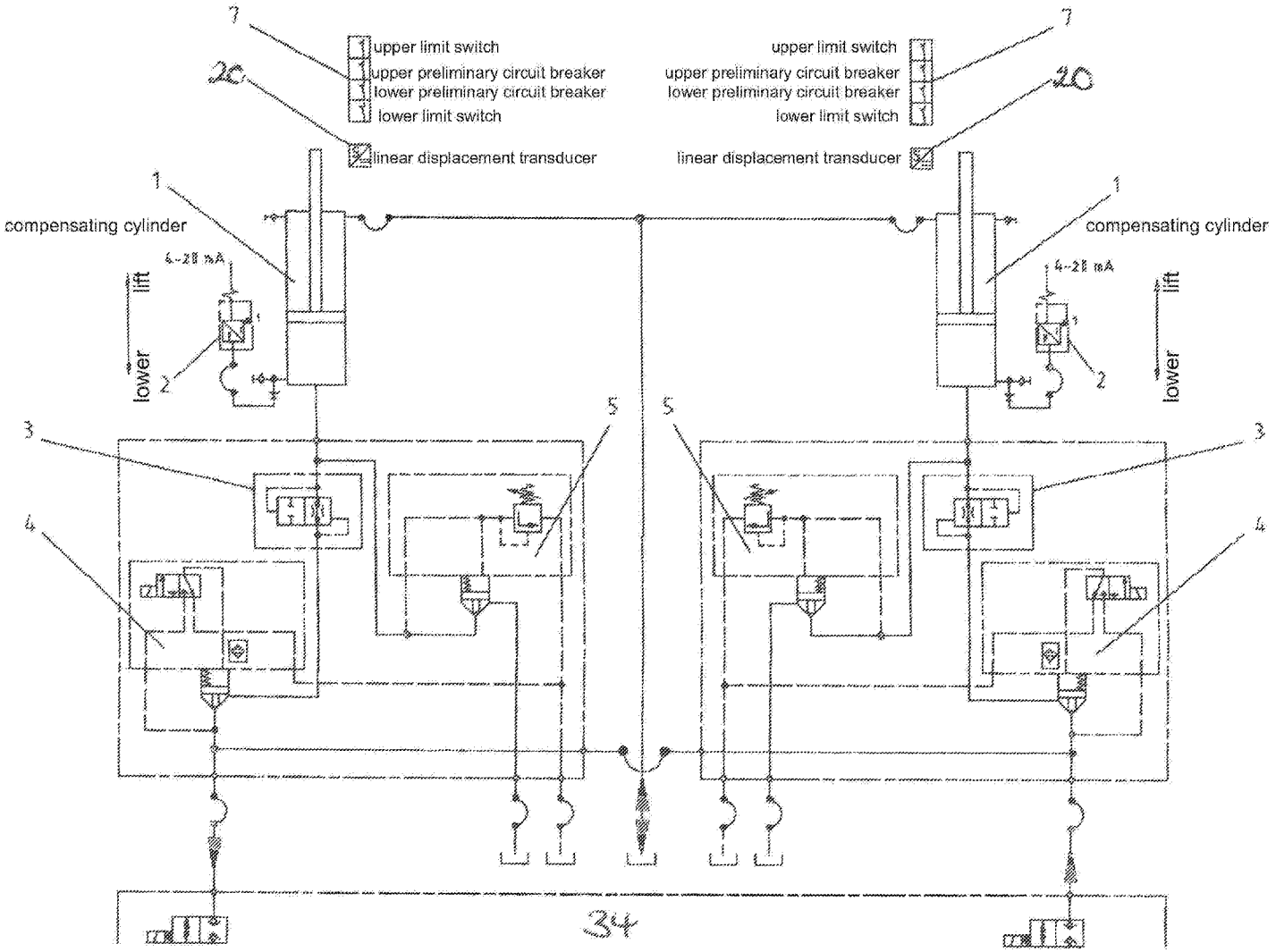
FIG. 8 a control scheme of the hydraulic system of the compensation sheave apparatus according to the preceding figures.

Finally, FIG. 8 shows a control scheme of the hydraulic system of the compensation sheave apparatus according to the preceding FIGS. 1 to 7. For the hydraulic compensation circuit a control block 1*a* is integrated on each cylinder 1. Via a pipe breaking cutout 3 and a switching valve 4, the cylinder volume can adjust between the two control blocks by means of a pipe or hose connection. At rope breakage load the arising excess pressure on the valve 5 is limited. By switching the valves 4, the corresponding compensating cylinder 1 is disabled and the second compensating cylinder 1 can be compensated in its lifting position with reference to the disabled cylinder by means of the direction control valves in the hydraulic unit. On the cylinder rod side the line connection serves for compensating the volumes and/or oil volume can be replenished from the oil tank of the hydraulic unit 34 upon rope breakage and lowering of the operating position. The pressure switches 2 indicate the change of the load conditions, and transmit the values to the electrical control (not shown). The displacement measuring devices 20 transmit the position of the respective sheave to the (not shown) electrical control. The limit switches 7 (7*a*, 7*b*) serve for giving a warning (operation blocking circuit) and end position cutout (system stopped by emergency braking).

The invention claimed is:

1. A compensation sheave arrangement for a drum winder comprising:

at least two sheaves that are vertically guided in slide frames and mounted on hydraulically short-circuited cylinders, wherein a multiply redundant monitoring of the varying rope loads acting on the sheaves is provided via the hydraulic cylinders, said monitoring being communicatively connected to a system control of the drum winder.

2. The compensation sheave arrangement according to claim 1, wherein the multiply redundant monitoring via the hydraulic cylinders of the varying rope loads acting on the sheaves comprises at least one linear displacement transducer, at least one limit switch and at least one cylinder pressure monitoring means.

3. The compensation sheave arrangement according to claim 1, wherein in each case a mechanical stop is provided above a lower end point of the respective cylinder for safe lowering of the slide frames in the event of an overload in the respective hydraulic short-circuit and for avoiding mechanical damage to the respective cylinder.

4. The compensation sheave arrangement according to claim 1, wherein the hydraulically short-circuited cylinders are arranged on a mechanical load balancing rocker having two sides with a mechanical stop on each sides for receiving the loads of the sheaves, said load balancing rocker being in balance when the loads on the sheaves are equal.

5. The compensation sheave arrangement according to claim 4, wherein the load balancing rocker is provided on both sides with a respective spring assembly permitting a tolerance value for the seesawing.

6. The compensation sheave arrangement according to claim 4, wherein on both sides of the rocker, a linear displacement transducer is respectively attached for measuring seesawing of the rocker, wherein a difference between paths of the linear displacement transducers is continuously monitored by the system control of the drum winder.

7. A method for operating a compensation sheave arrangement for a drum winder with at least two sheaves that are vertically guided in slide frames and mounted on hydraulically short-circuited cylinders, comprising:

monitoring via the hydraulically short-circuited cylinders of the varying rope loads acting on the sheaves, said monitoring being multiply redundant and communicatively connected to a system control of the drum winder.

8. The method according to claim 7, wherein the multiply redundant monitoring comprises the following steps of:

a. continuously monitoring positions of the cylinders by a distance measuring system;

b. monitoring positions of the cylinders by the provision of limit switches at transition points of operating ranges of the cylinders;

c. continuously monitoring pressure in the cylinders and discharging oil from a cylinder into a tank upon a cylinder pressure exceeding a defined value, as well as lowering the slide frames on mechanical stops above the lower end points of the cylinders.

9. The method according to claim 7, wherein for monitoring a malfunction of a hydraulical operating system, a mechanical load balancing rocker is provided which has a bilateral, mechanical stop for receiving loads of the sheaves and is in balance when the loads on the sheaves are equal.

10. The method of claim 9, wherein in order to prevent the indication of very small load differences and to counteract a continuous tipping of the load balancing rocker, spring assemblies are provided between the cylinders and the load balancing rocker, said spring assemblies permitting a tolerance value for seesawing of the rocker, wherein, when the tolerance value is exceeded, the rocker rests on one side and a damage to the system is prevented by a corresponding signal to the system control of the drum winder.

11. The method according to claim 9, wherein further on both sides of the load balancing rocker one respective linear displacement transducer is provided, wherein a difference in paths of the linear displacement transducers is continuously monitored by the system control of the drum winder, and if the difference exceeds the tolerance value, a malfunction of the system is detected and a safety braking of drum winder is triggered.

12. The method according to claim 7, wherein the hydraulically short-circuited cylinders are configured such that for maintenance purposes the cylinders can be lifted and lowered jointly or separately.

13. A compensation sheave system for a drum winder comprising:

first and second slide frames;

a first guide rail mounted on said first slide frame;

a second guide rail mounted on said second slide frame;

a first hydraulic cylinder;

a second hydraulic cylinder;

a first sheave mounted on said first hydraulic cylinder and vertically guided in said first slide frame by said first guide rail;

a second sheave mounted on said second hydraulic cylinder and vertically guided in said second slide frame by said second guide rail; and a plurality of sensors for monitoring of varying rope loads acting on the sheaves, said monitoring being communicatively connected to a system control of a drum winder.

14. A compensation sheave system according to claim 13, wherein said plurality of sensors comprise:

a linear displacement transducer;

a limit switch; and a cylinder pressure monitoring means.

15. A compensation sheave system according to claim 13, further comprising:

a mechanical stop on said first frame above a lower end point of said first hydraulic cylinder for safe lowering of said first slide frame in the event of an overload in the first hydraulic cylinder and for avoiding mechanical damage to the first hydraulic cylinder.

16. A compensation sheave system according to claim 13, further comprising:

a mechanical load balancing rocker having first and second sides with a mechanical stop on each of said first and second sides, wherein said mechanical load balancing rocker receives a load of said first sheave on said first side and a load of said second sheave on said second side, said mechanical load balancing rocker being in balance when loads on the first and second sheaves are equal.

* * * * *